US006812917B2

(12) United States Patent
Jenkins et al.

(10) Patent No.: US 6,812,917 B2
(45) Date of Patent: Nov. 2, 2004

(54) TILT SCREEN MODULE FOR SELF-SERVING MONEY MACHINES

(76) Inventors: Stuart M. Jenkins, 105 Aldwick Road, Bognor Regis, W. Sussex (GB), P021 2NY; Derek Haynes, 676 Thrush Ct., Marco Island, FL (US) 34145

( * ) Notice: Subject to any disclaimer, the term of this patent is extended or adjusted under 35 U.S.C. 154(b) by 541 days.

(21) Appl. No.: 09/935,110

(22) Filed: Aug. 23, 2001

(65) Prior Publication Data

US 2002/0024488 A1 Feb. 28, 2002

Related U.S. Application Data

(60) Provisional application No. 60/226,731, filed on Aug. 22, 2000.

(51) Int. Cl.[7] ..... G09G 5/00

(52) U.S. Cl. ..... 345/156; 345/87; 345/102; 361/681

(58) Field of Search ..... 361/679, 681, 361/682; 248/917; 345/156; 340/825.19

(56) References Cited

U.S. PATENT DOCUMENTS 4,440,457 A * 4/1984 Fogelman et al. ..... 463/46
5,190,302 A * 3/1993 Trotta ..... 280/35
6,296,079 B1 * 10/2001 McNaughton ..... 186/37

* cited by examiner

*Primary Examiner*—Alexander Eisen
(74) *Attorney, Agent, or Firm*—John P. McGonagle

(57) ABSTRACT

A money dispensing machine with a tiltable screen module. The tiltable screen display module has two side handles for vertically tilting the face of the screen. Each tiltable display side has a heavy duty pivot mechanism fitted with a torque limiting device to provide constant friction resistance, each said pivot mechanism adapted to engage a display module side.

12 Claims, 6 Drawing Sheets

TILT SCREEN MODULE FOR SELF-SERVING MONEY MACHINES

This application claims the benefit of prov. application 60/226,731 filed on Aug. 22, 2000.

BACKGROUND OF THE INVENTION

This invention relates to money dispensing machines, and more particularly to a money machine with a customer-tiltable display.

As the use of money machines becomes more wide spread, ergonomic considerations for users must be considered, especially for handicapped users.

SUMMARY OF THE INVENTION

The present invention addresses the ergonomic needs of users of money dispensing machines by providing a money dispensing machine with a tiltable screen module. The screen module is easily manipulated by a user to rotatably tilt the screen module up or down to a position most comfortable for a user.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 2:
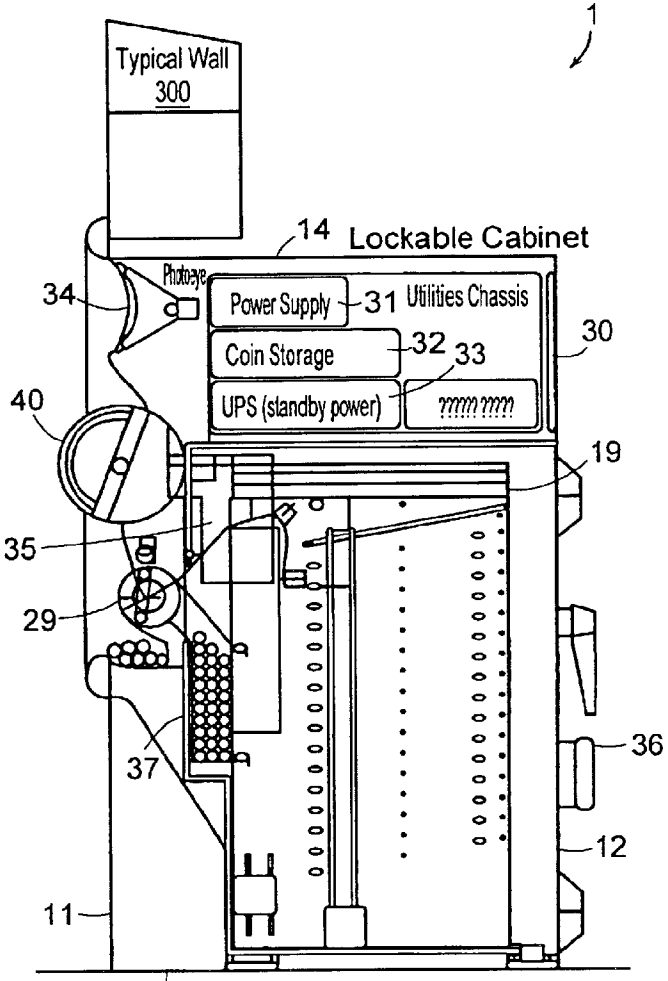
FIG. 2 is a side view of the machine of FIG. 1, partly in section.
Figure 1:
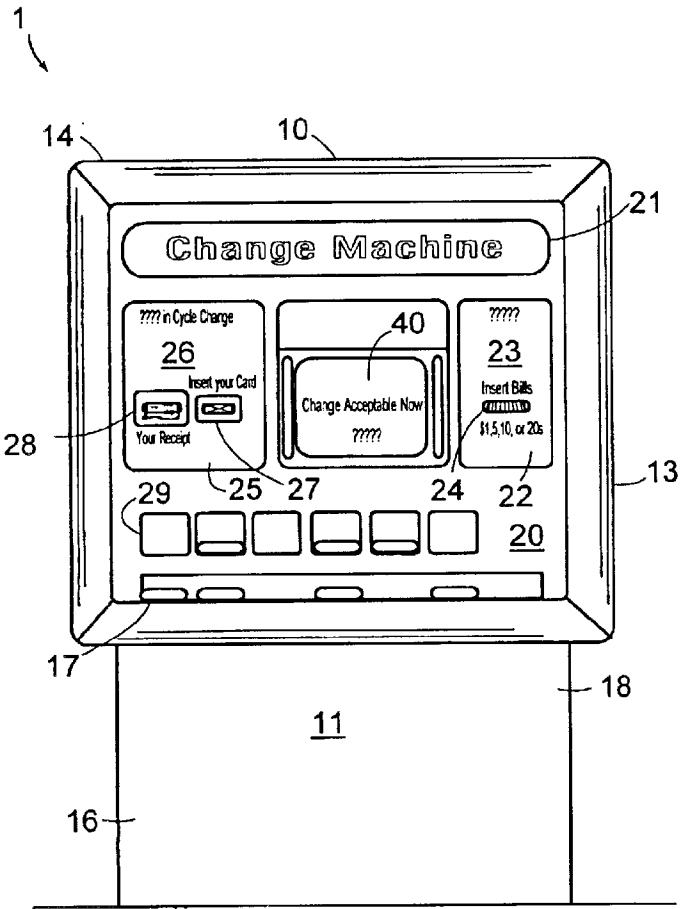
FIG. 1 is a front view of a money changing machine constructed according to the present invention.
Figure 4:
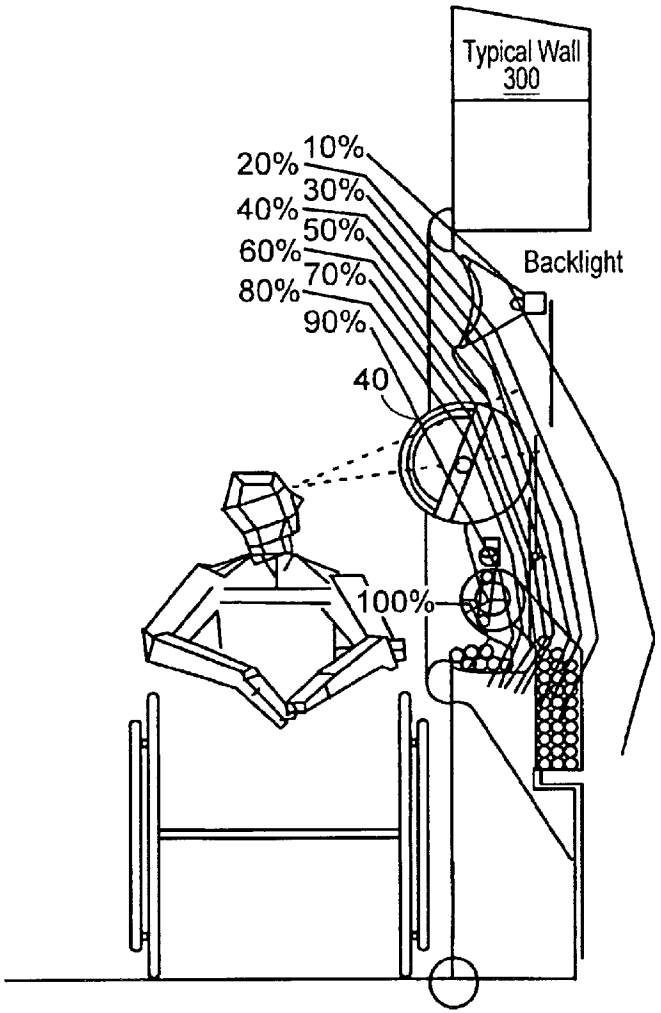
FIG. 4 is a side view of the user in FIG. 3 making a transaction.
Figure 3:
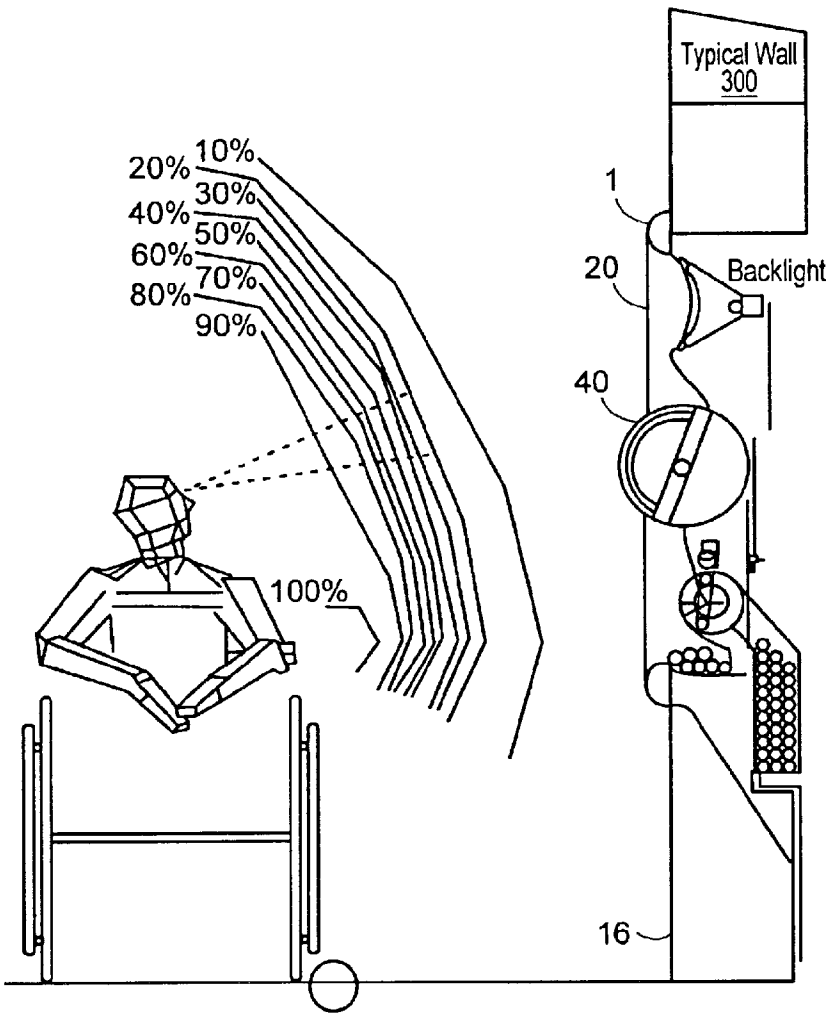
FIG. 3 is a side view of a user in a wheel chair making a side approach to the machine of FIG. 1.
Figure 6:
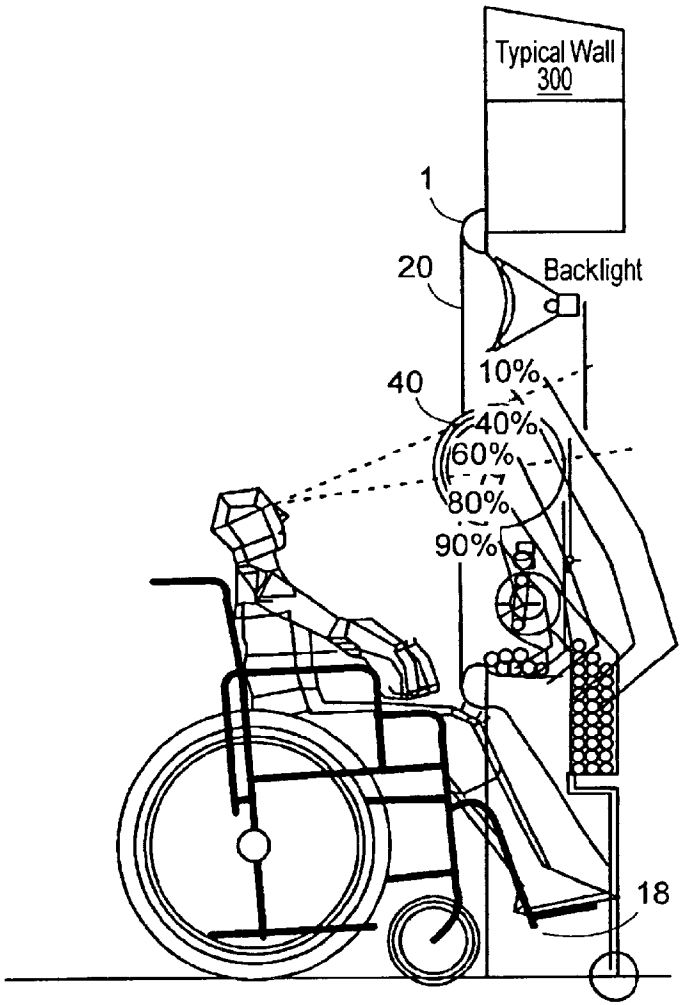
FIG. 6 is a side view of the user in FIG. 5 making a transaction.
Figure 5:
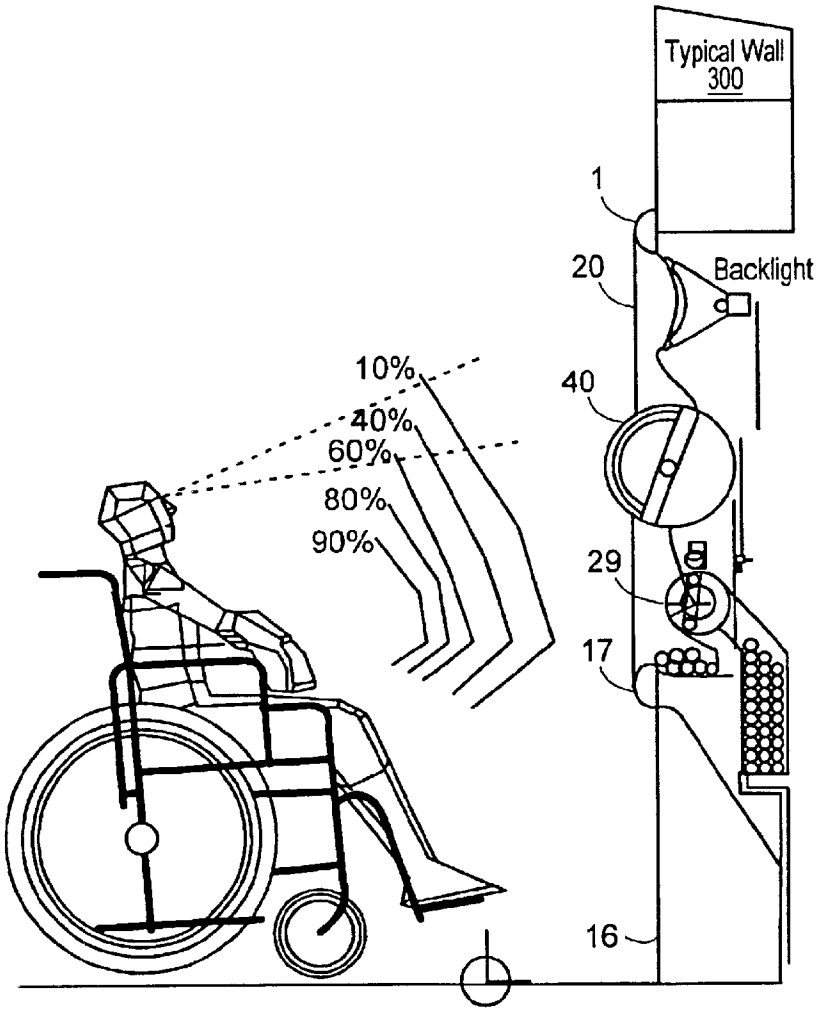
FIG. 5 is a side view of a user in a wheel chair making a frontal approach to the machine of FIG. 1.
Figure 8:
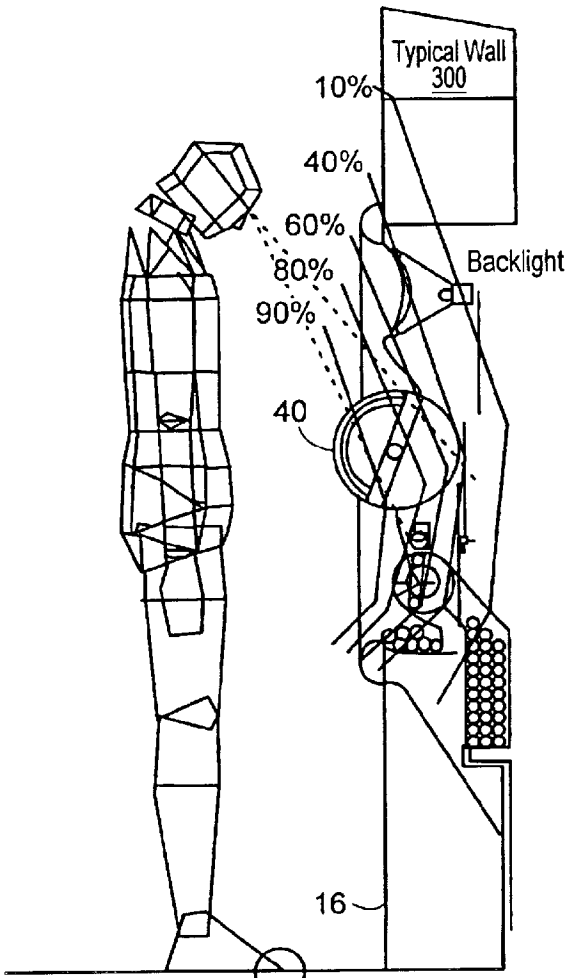
FIG. 8 is a side view of the user in FIG. 7 making a transaction.
Figure 7:
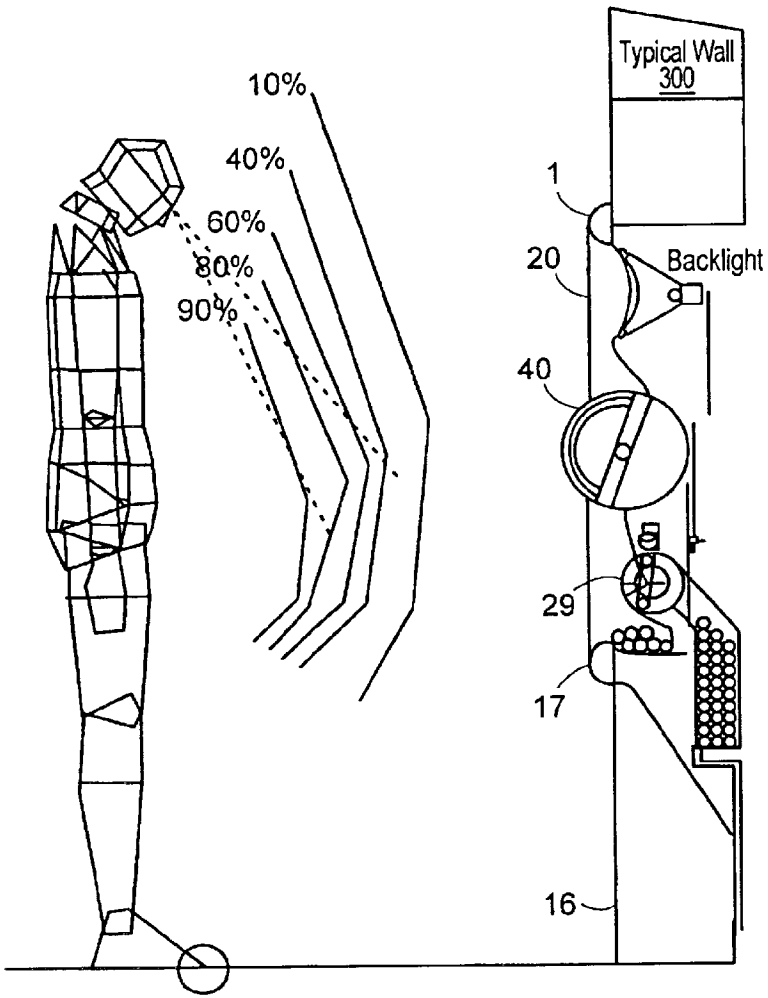
FIG. 7 is a side view of an able-bodied user making a side approach to the machine of FIG. 1.

Referring to the drawings in detail wherein like elements are indicated by like numerals, there is shown a money changing machine 1 constructed according to the present invention. The machine 1 is encased within a housing 10 having a front 11, rear 12, two sides 13, a top 14 and a bottom 15. The housing front 11, rear 12, two sides 13, top 14 and bottom 15 define a housing interior 19. The housing front 11 is divided into an upper transaction portion 20 and a lower support portion 16.

The housing front upper transaction portion 20 has an upper back-lit nameplate area 21, a middle right section 22, a middle left section 25 and a middle central display module 40. The middle right section 22 has an instructions area 23 and a banknote reader 24. The middle left section 25 has a greeting area 26, a magnetic card reader 27, and a transaction ticket printer 28. The front upper transaction portion 20 has a plurality of lower dispensed coin presenters 29. The front upper transaction portion 20 and lower support portion 16 are separated by a horizontal customer coin shelf 17. The front lower support portion 16 is inwardly formed into a kneehole/footspace 18.

As may be most clearly seen from FIG. 2, the housing interior 19 contains an upper utilities cabinet 30 with power supply 31, coin storage 32, uninterruptable power supply (UPS) 33, and such other equipment as may be desirable. Between the utilities cabinet 30 and the front upper name plate area 21 is light 34 for back-lighting the name plate 21. The housing rear 12 is secured with safe locks 36. The portion 35 of the housing interior 19 below the utilities cabinet 30 holds the money dispensing apparatus 37 of the money changing machine 1.

Figure 9:
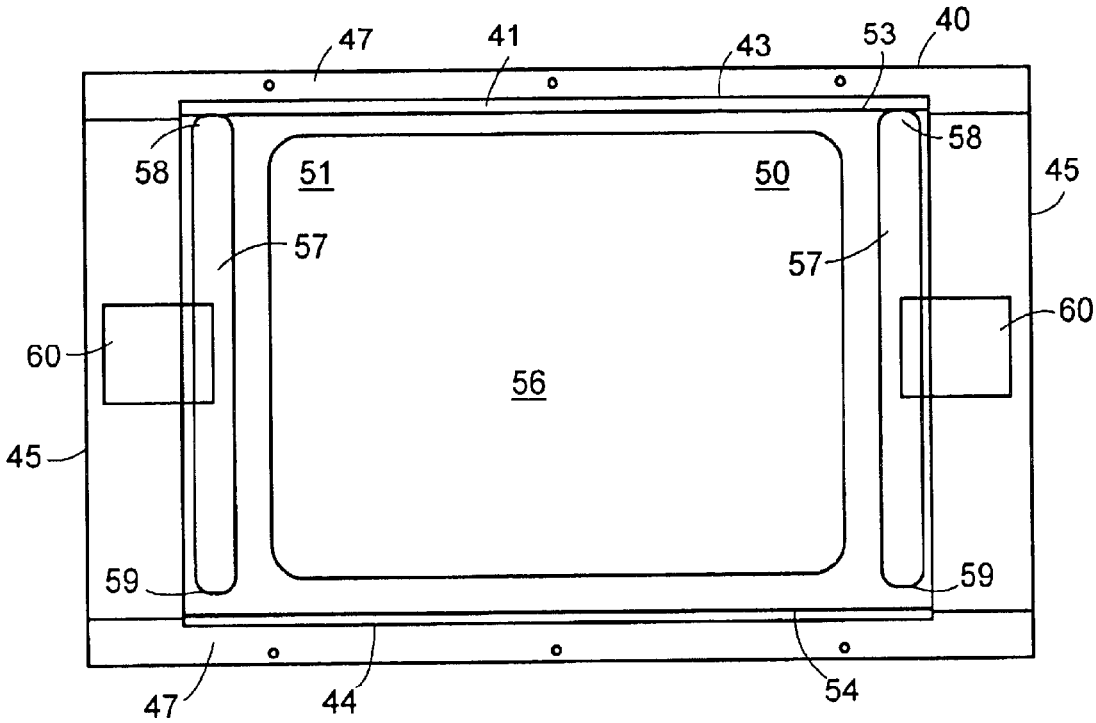
FIG. 9 is a front view of the tilt screen module.
Figure 10:
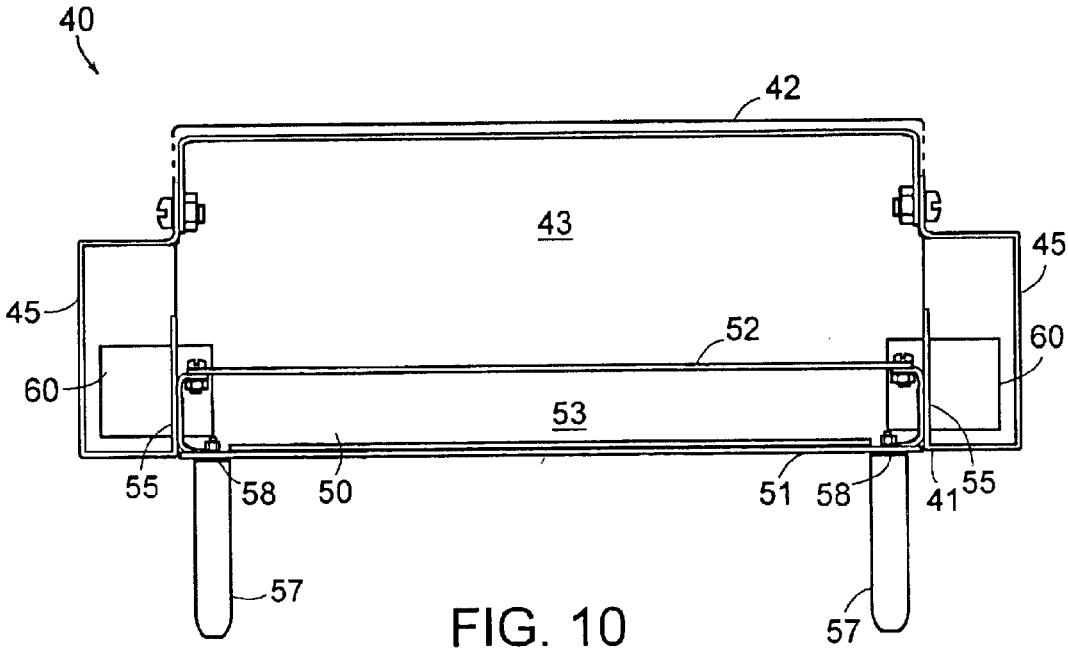
FIG. 10 is a top view of the tilt screen module.
Figure 11:
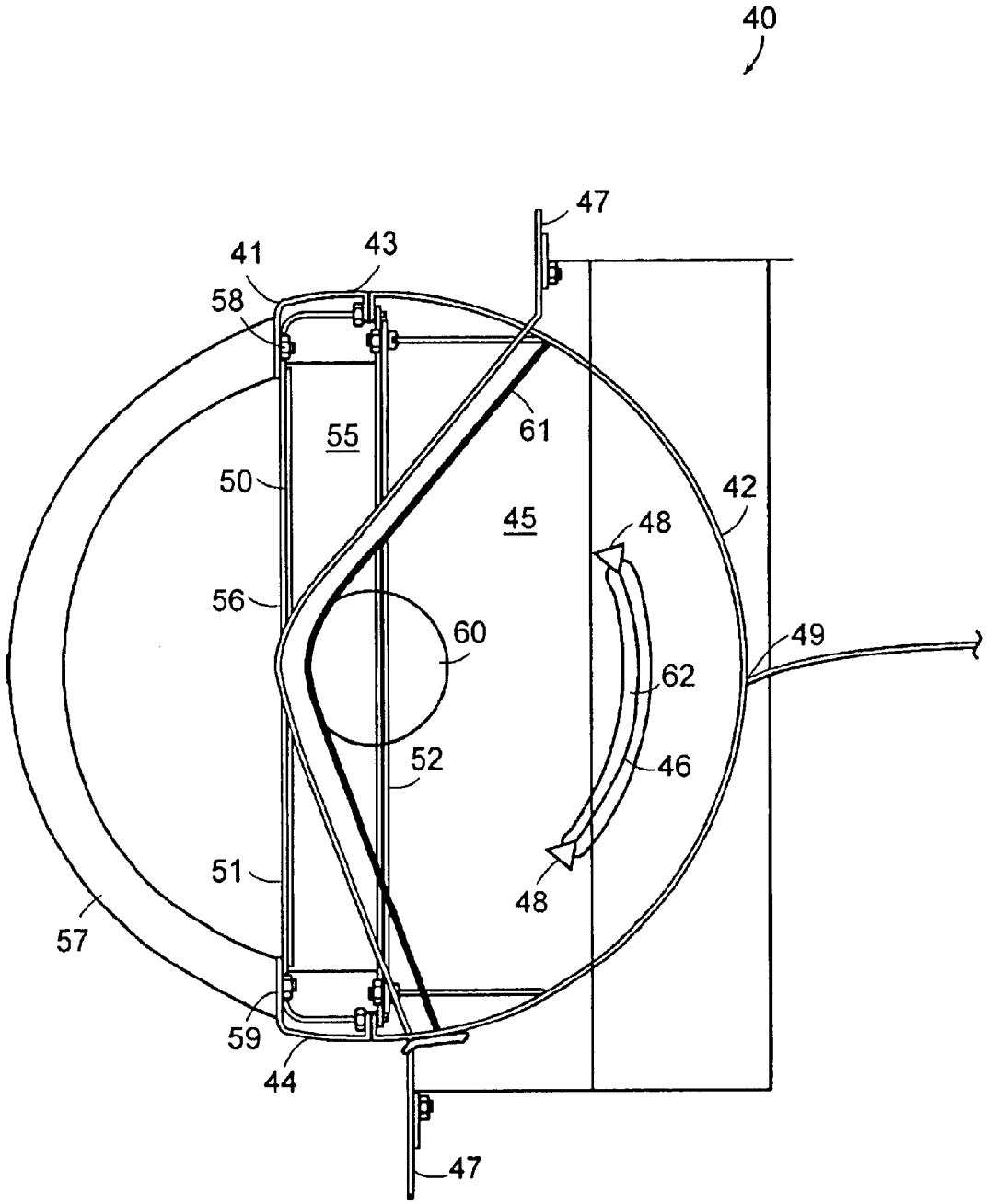
FIG. 11 is a side view of the tilt screen module.

Referring again to the drawings and in particular to FIGS. 9–11, the central display module 40 has an open front 41, rear 42, top 43, bottom 44 and two sides 45. Within the display module 40 there is a tiltable display 50 having a front 51, rear 52, top 53, bottom 54 and two sides 55. The tiltable display front 51 has a front facing, flat screen 56, said screen 56 in this embodiment being made from liquid crystal display material (LCD) or material with similar properties. The tiltable display 50 has two handles 57, each attached to the tiltable display front 51 adjacent to a display module side 55. In this embodiment of the invention each handle 57 is formed into a forwardly extending, upright, semi-circle, with an upper handle end 58 being attached to the tiltable display front 51 adjacent the tiltable display top 53 and a side 55, and with a lower handle end 59 being attached to the tiltable display front 51 adjacent the tiltable display bottom 54 and a side 55. The handles 57 are formed from pipe and plated.

The tiltable display 50 is tiltable within the display module 40 along a radial axis parallel to the plane of the machine housing sides 13. Each tiltable display side 55 has a heavy duty pivot mechanism 60 fitted with a torque limiting device to provide constant friction resistance, each said pivot mechanism 60 adapted to engage a display module side 45. The tiltable display 50 has brush seals 61 around its sides 55 to prevent ingress of foreign bodies. The display module rear 42 has a strain resistant cable exit 49 for power and data connection to the tiltable display 50.

The tiltable display sides 55 also each have a pin 62 protruding therefrom. The tiltable display side pins 62 are adapted to engage curved slots 46 in the display module sides 45. The purpose of the slots 46 and engaging pins 62 is to limit the angle of tiltable display tilt. The display module top 43 and bottom 44 each have a protruding flange 47 for display module attachment to the housing front upper transaction portion 20. The curved slots 46 may have dampers 48 at each end to cushion the tilt limit of the tiltable display 50.

It is understood that the above-described embodiment is merely illustrative of the application. Other embodiments may be readily devised by those skilled in the art which will embody the principles of the invention and fall within the spirit and scope thereof.

We claim:

1. In a money dispensing machine encased within a housing having a front, rear, two sides, a top and a bottom, said housing front, rear, two sides, top and bottom defining a housing interior, said housing front being divided into an upper transaction portion and a lower support portion, a tiltable screen display module, comprising:

said housing front upper transaction portion having an upper back-lit nameplate area, a middle right section, a middle left section and a middle central display module;

said housing front lower support portion being inwardly formed into a kneehole/footspace;

said housing interior containing an upper utilities cabinet with power supply, coin storage, and uninterruptable power supply;

said middle central display module having an open front, rear, top, bottom and two sides;

a tiltable screen display within said display module, said tiltable screen display having a front, rear, top, bottom and two sides, said tiltable screen display front having a front facing, flat screen, said tiltable screen display having two handles, each said handle being attached to the tiltable screen display front adjacent to a display module side;

a pivot mechanism attached to each tiltable screen display side, each said pivot mechanism being fitted with a torque limiting device to provide constant friction resistance, each said pivot mechanism adapted to engage a display module side;

wherein the tiltable screen display is tiltable within the display module along a radial axis parallel to the planes of the machine housing sides.

2. A tiltable screen display module as recited in claim 1, further comprising:

a pin protruding from each tiltable screen display side;

a curved slot in each display module side, each said curved slot having two ends;

wherein said tiltable screen display side pins are adapted to engage said display module side curved slots;

wherein said slots and engaging pins limit the angle of tiltable screen display tilt.

3. A tiltable screen display module as recited in claim 2, further comprising:

a strain resistant cable exit in said display module rear adapted for power and data connection to the tiltable screen display.

4. A tiltable screen display module as recited in claim 3, wherein:

each said handle is formed into a forwardly extending, upright, semi-circle, with an upper handle end attached to the tiltable screen display front adjacent the tiltable screen display top and a side, and with a lower handle end attached to the tiltable screen display front adjacent the tiltable screen display bottom and a side.

5. A tiltable screen display module as recited in claim 4, further comprising:

brush seals attached about the tiltable screen display sides, said brush seals adapted to prevent ingress of foreign bodies.

6. A tiltable screen display module as recited in claim 5, further comprising:

dampers at each curved slot end, said dampers adapted to cushion a tilt limit of the tiltable screen display.

7. A tiltable screen display module as recited in claim 6, further comprising:

a first protruding flange attached to the display module top and a second protruding flange attached to the display module bottom, said flanges adapted to for display module attachment to the housing front upper transaction portion.

8. A tiltable screen display module as recited in claim 7, wherein:

said handles are formed from pipe and plated.

9. A tiltable screen display module as recited in claim 8, wherein:

said screen is made from liquid crystal display material.

10. A tiltable screen display module as recited in claim 9, wherein:

the front upper transaction portion and lower support portion are separated by a horizontal customer coin shelf.

11. A tiltable screen display module as recited in claim 10, wherein:

a light for back-lighting the name plate is positioned between the utilities cabinet and the front upper name plate area;

a money dispensing apparatus is positioned within the lower support portion.

12. A tiltable screen display module as recited in claim 11, wherein:

said housing front upper transaction section middle right section has an instructions area and a banknote reader;

said middle left section has a greeting area, a magnetic card reader, and a transaction ticket printer;

said front upper transaction portion has a plurality of lower dispensed coin presenters.

* * * * *